US007146322B2

(12) United States Patent
Cowgill

(10) Patent No.: US 7,146,322 B2
(45) Date of Patent: Dec. 5, 2006

(54) INTERLEAVING OF INFORMATION INTO COMPRESSED DIGITAL AUDIO STREAMS

(75) Inventor: Clayton Neil Cowgill, Vancouver, WA (US)

(73) Assignee: Sigmatel, Inc., Austin, TX (US)

( * ) Notice: Subject to any disclaimer, the term of this patent is extended or adjusted under 35 U.S.C. 154(b) by 385 days.

(21) Appl. No.: 10/123,977

(22) Filed: Apr. 16, 2002

(65) Prior Publication Data

US 2003/0195752 A1 Oct. 16, 2003

(51) Int. Cl.
*G10L 21/00* (2006.01)

(52) U.S. Cl. ..... 704/270.1; 707/3; 713/176

(58) Field of Classification Search ..... 704/500, 704/223, 501, 233, 270.1, 270, 275, 273, 704/201; 707/102, 205, 104.1, 3; 709/231, 709/233; 713/176; 455/45, 102; 379/88.17, 379/91.01; 386/46, 125; 375/240.11; 714/4, 714/43, 48; 715/716, 719

See application file for complete search history.

(56) References Cited

U.S. PATENT DOCUMENTS

| | | | | |
|---|---|---|---|---|
| 5,659,539 | A * | 8/1997 | Porter et al. | 709/231 |
| 5,664,226 | A * | 9/1997 | Czako et al. | 707/102 |
| 5,708,796 | A * | 1/1998 | Ozden et al. | 707/205 |
| 5,761,692 | A * | 6/1998 | Ozden et al. | 707/205 |
| 5,802,314 | A * | 9/1998 | Tullis et al. | 709/246 |
| 5,941,951 | A * | 8/1999 | Day et al. | 709/233 |
| 6,111,567 | A * | 8/2000 | Savchenko et al. | 707/104.1 |
| 6,289,165 | B1 * | 9/2001 | Abecassis | 386/46 |
| 6,411,725 | B1 * | 6/2002 | Rhoads | 382/100 |
| 6,588,015 | B1 * | 7/2003 | Eyer et al. | 704/500 |
| 6,661,927 | B1 * | 12/2003 | Suarez et al. | 382/240 |
| 6,678,267 | B1 * | 1/2004 | Anandakumar et al. | 704/223 |
| 6,801,604 | B1 * | 10/2004 | Maes et al. | 379/88.17 |
| 2003/0158737 | A1 * | 8/2003 | Csicsatka | 704/273 |
| 2003/0187662 | A1 * | 10/2003 | Wilson | 704/500 |
| 2003/0194968 | A1 * | 10/2003 | Young | 455/45 |

FOREIGN PATENT DOCUMENTS

JP 2000-056813 * 2/2000

OTHER PUBLICATIONS

Mohebbi et al ("A Case Study Of Mapping A Software-Defined Radio (SDR) Application On A Reconfigurable DSP Core", Proceedings of the 1st IEEE/ACM/IFIP International Conference On Hardware/Software Codesign & System Synthesis, Oct. 2003).*

Chandrakasan et al ("Low Power Chipset For Portable Multimedia Applications", IEEE International Solid-State Circuits Conference, Feb. 1994).*

Wang et al ("Spread Spectrum Multiple-Access With DPSK Modulation And Diversity For Image Transmission Over Indoor Radio Multipath Fading Channels", IEEE Transactions on Circuits and Systems for Video Technology, Apr. 1996).*

Annunziato et al ("3 TETRA Radio Performance Evaluated Via The Software Package TETRASIM", Mobile Networks and Applications, Mar. 2000).*

* cited by examiner

*Primary Examiner*—Vijay B. Chawan
(74) *Attorney, Agent, or Firm*—Toler Schaffer, LLP

(57) ABSTRACT

A digital audio device including a communications port to connect the device to a server and a controller to allow transfer of digital audio files from the server. The digital audio files may include non-audio data interleaved with the digital audio files and the device will include a decoder to decode the non-audio data.

21 Claims, 2 Drawing Sheets

INTERLEAVING OF INFORMATION INTO COMPRESSED DIGITAL AUDIO STREAMS

BACKGROUND

1. Field

This disclosure relates to digital audio, more particularly to methods to include information into streams of digital audio data.

2. Background

Digital audio players have several advantages over tape or CD players. Digital audio players are solid-state, having few, if any moving parts. This makes them more rugged than tape or CD players. In addition, the digital nature of the devices allows them to offer some different features than would normally be available on tape or CD players. They may receive and store additional information related to each audio file, which may be referred to as a track. Examples of tracks would include tracks from a CD, or a chapter from an audible book, similar to a book-on-tape.

Currently, the methods to embed non-audio information into audio files involve modifications to the standardized file, including modification to the native file structure and the layout of the file. These need to be agreed upon and implemented by all parties in the solution chain, audio encoders, personal computer based applications, web servers and databases, as well as the playback devices. This makes the addition of additional information problematic and largely impractical. Additionally, not all of the playback devices will use the additional information. These approaches do not make any accommodations for specific configurations of playback devices.

Therefore, methods and associated devices that can interleave non-audio information into standardized formats and do so in such a manner that takes into account specific capabilities of the playback devices.

SUMMARY

One embodiment is a digital audio device. The device includes a communications port to connect the device to a server and a controller to allow transfer of digital audio files from the server. The digital audio files may include non-audio data interleaved with the digital audio files and the device will include a decoder to decode the non-audio data. The device may also include a unique identifier that is transmitted to the server to inform the server of unique characteristics of the device that may affect the non-audio information included. One example of non-audio information would be meter display data, such as spectrum analyzer, VU meter or FFT data.

BRIEF DESCRIPTION OF THE DRAWINGS

The invention may be best understood by reading the disclosure with reference to the drawings, wherein.

DETAILED DESCRIPTION OF THE EMBODIMENTS

As mentioned previously, current techniques to embed information associated with an audio track involve making changes to the native file structure and standardized file formats to include the non-audio information. One example of this is the 'ID3' tag, which allows information to be inserted into MP3 (Moving Pictures Experts Group, audio layer 3) files.

In ID3 version 1.0, the information to be inserted had to be 128 bytes or less. ID3 version 1.1 allows for manipulations of the format of the 128 bytes to allow more information to be included. ID3 version 2.0 can now have up to 256 MB of information included in the MP3 file. The implementation of ID3 tags requires all of the parties in the chain to have agreed upon the format. Every change to the format requires approval by all of the parties. Additionally, in the new version of ID3, the user may download a huge file that includes data for applications that the user's device cannot utilize. The user then wastes the time waiting for the unusable data to be downloaded and the desired content now comes with a huge memory overhead that the user may not be able to eliminate.

Figure 1:
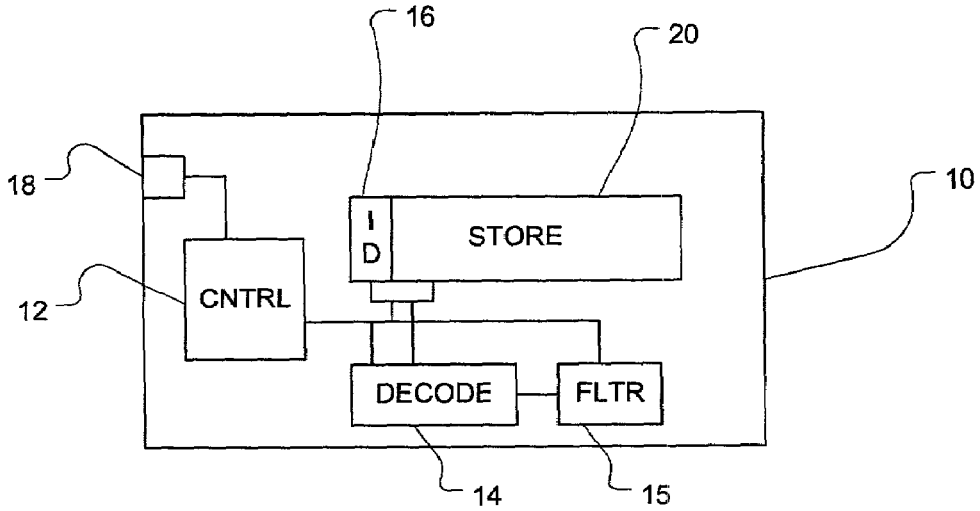
FIG. 1 shows a digital audio device, in accordance with the invention.

FIG. 1 shows a digital audio device 10. The digital audio device 10 may include a port 18 that allows the device to be connected to a server, as will be discussed with regard to FIGS. 2*a* and 2*b*. The device may also include a controller 12 to allow transfer of digital audio files from the server. The digital audio files may have interleaved digital data included with the digital audio files. The interleaved data will be referred to as non-audio data, although in some embodiments the data may actually be audio data. The decoder 14 extracts the interleaved data from the transmitted digital audio file with interleaved data and allows the user to have separate access to the non-audio data and the audio data.

In addition to the above components, the digital audio player may also include a store 20 for storing digital audio files and non-audio data. As part of this store, the player may also save a unique, device-specific identifier 16 that allows the server to identify the device and its capabilities when communication is established between the device and a server. This identification provides the opportunity to customize the interleaved data to leave out that data which the device cannot use. This avoids the unnecessary overhead of downloading and storing unusable information.

In addition to customized data, or as an alternative, the device may include a filter 15 that can also remove unwanted or unusable information. This filter could be predefined for a particular device, such as filtering out data directed to display capabilities on a device that has no display. Alternatively, the user could control the filter to remove the unwanted data. As the user adds or removes capabilities to a particular device, the user can change the filter settings.

The digital audio device 10 could be one of several different devices. For example, the device could be a personal computer, a portable digital audio device, such as a portable MP3 player, or a 'console' digital audio player. A console digital audio player would be one that is used in a home entertainment system, or a stand-alone cabinet, not a portable. The device would be the 'client' in the interaction between the server and the device. The term 'server' as used here is not limited to an actual server. Instead, the term is used as the definition of a role, any repository of music content that 'serves' that content up to a client. Examples of two alternative embodiments are shown in FIGS. 2*a* and 2*b*.

Figure 2A:
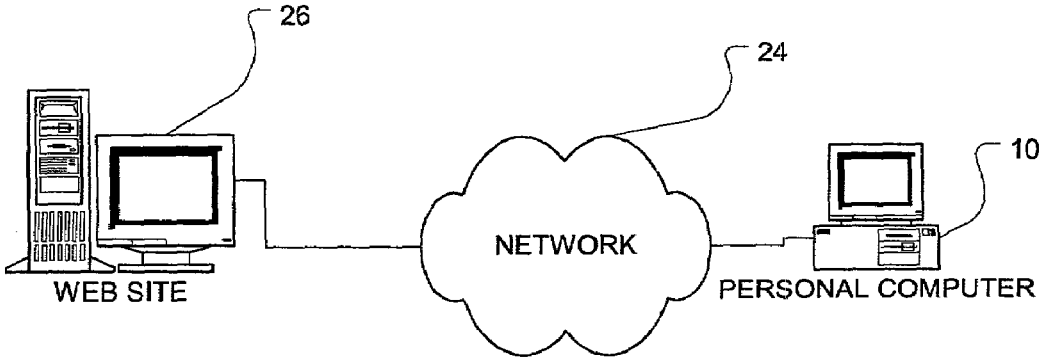
FIGS. 2*a* and 2*b* show alternative embodiments of a client/server arrangement for transfer of audio files and information, in accordance with the invention.
Figure 2B:
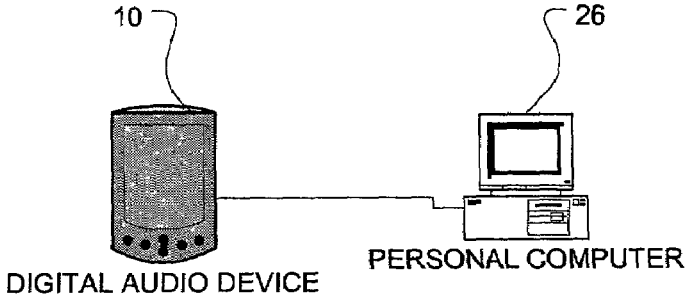

In FIG. 2*a*, the digital audio device 10 is a personal computer connected by network 24 to a web site server 26. In this interaction, the web site server is the 'server' and the personal computer is the 'client.' Other embodiments could be a portable digital audio device 10 connected to the personal computer as server 26, as shown in FIG. 2*b*. Other alternatives include an "Internet" appliance acting as the client to a network server, or acting as a server to a portable digital audio player.

Figure 3:
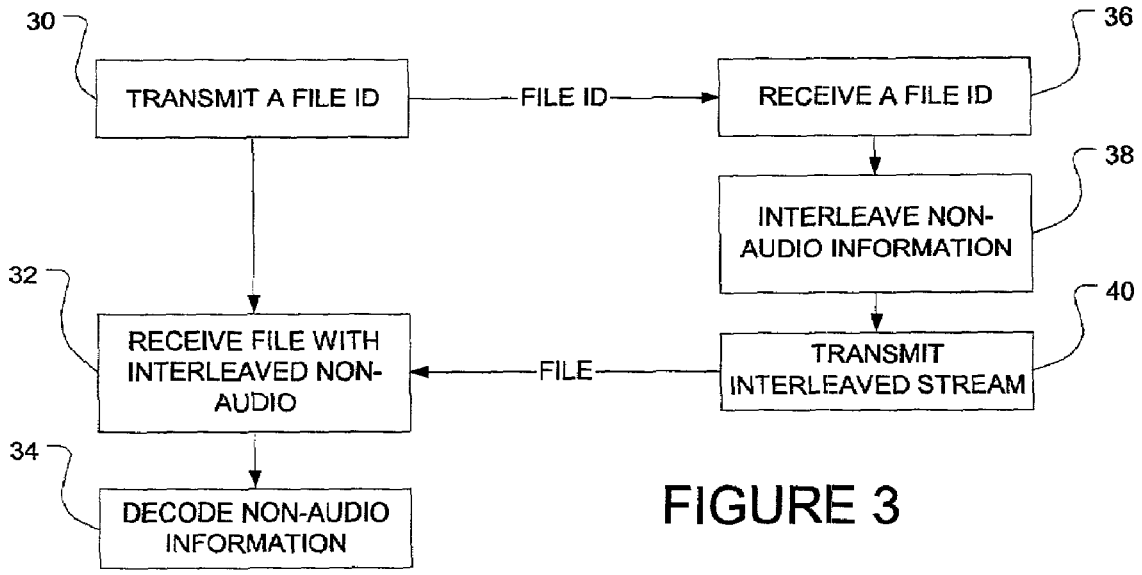
FIG. 3 shows a flowchart of an embodiment of a method of communicating between a host and a client, in accordance with the invention.

The server transmits the digital audio file in a standardized format, such as MP3, WMA, WAV, etc., with non-audio information interleaved into the data stream. At the other end of the transmitted stream, the digital audio device extracts the interleaved data and stores the digital audio data in its standard format. An embodiment of this type of transaction is shown in FIG. 3.

At 30, communications between the digital audio device and the server has been established. A file identifier of some sort is transmitted to the server at 30. The file identifier may be no more complicated than an audio track name. The server receives the file ID at 36 and interleaves the non-audio information with the digital audio file at 38. The non-audio data may be predefined based upon the digital audio file, or it may be identified at the time the file ID is received. This is especially true if the device also transmits a device ID.

For example, the file name may be received and the contents of the file of non-audio information have already been established and stored. The server would then just interleave the two files and transmit them. The pre-established non-audio information may still be updated off-line away from the transaction between the server and the client. Alternatively, the file of non-audio information may be created when the file name is received. If the device has also transmitted a device identifier, the contents of the non-audio file may change depending upon the device. For example, if the device does not have the capability to display much information, the non-audio file may be altered prior to transmission to eliminate more detailed graphics or other higher-level display data.

The nature of the non-audio information has very few limitations on it. The information could be something like a web site uniform resource locator (URL), graphics and text from a CD label, or embedded special offers. Device-specific non-audio information may include the proper equalizer settings for a particular piece of music on a particular type of device, or 'hint' data that allows the player to equalize the volume control across several different songs. As will be discussed with more detail with regard to FIG. 4, the additional information may include display data.

The server then transmits it as an interleaved stream back to the device at 40. At 32, the device receives the interleaved data at 32 and decodes it at 34. Decoding may involve nothing more than extracting the non-audio information from the stream and storing it in such a manner as to be associated with the particular file. This non-audio information is now available to the user without requiring any changes to the file format or structure. Additionally, interleaving the data rather than appending it to the beginning or end of the file may cause less overhead to be wasted on transmission time.

Figure 4:
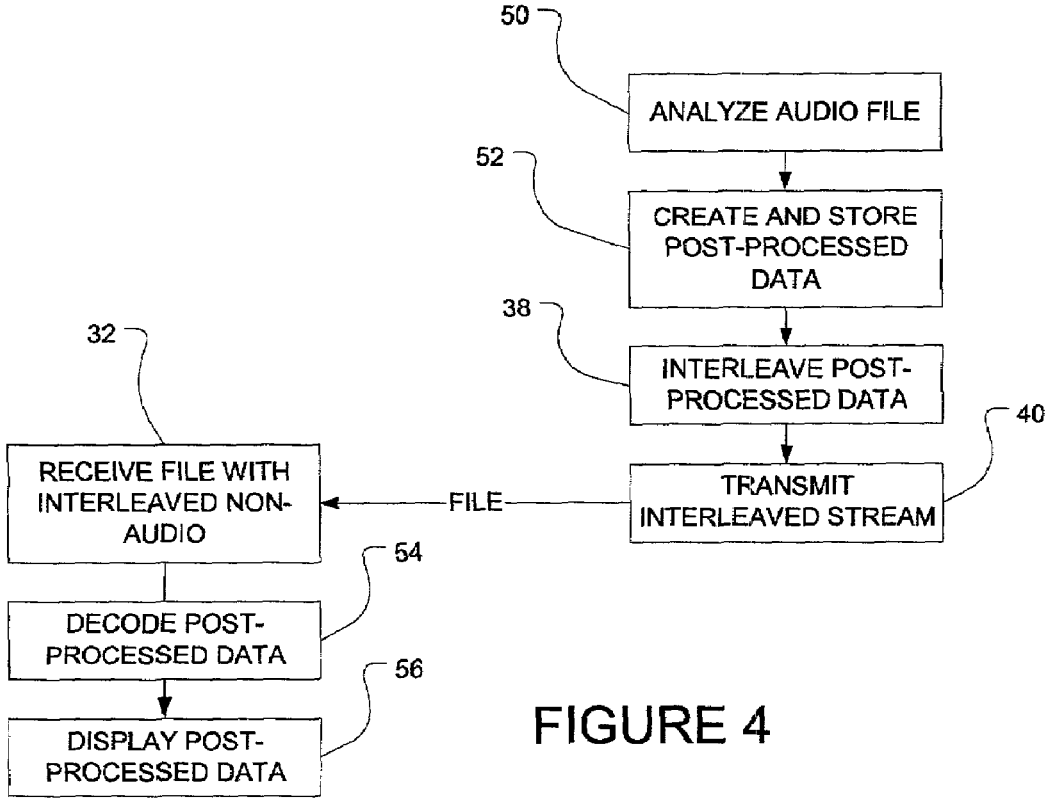
FIG. 4 shows a flowchart of an embodiment of a method of communicating information relating to a display, in accordance with the invention.

As mentioned above, the non-audio information may include display data. Some devices have the capability of display spectrum analyzer data, VU meter data or FFT (Fast Fourier Transform) data associated with a digital audio file. However, many digital audio devices, being portable, do not have either processing power or the memory to perform the audio analysis and store intermediate results prior to creating the display data. A specific embodiment of a file transfer including non-audio information where the non-audio information is display data is shown in FIG. 4.

For ease of understanding of this embodiment, the same reference numbers from FIG. 3 are used to show how this particular embodiment is a specific example of the more general embodiment. After the file is identified, as in 36 in FIG. 3, the audio file is analyzed at 50 by the host or server, which will typically have more processing power than the client. The post-processed data corresponding to the audio analysis, such as the VU meter data, the spectrum analyzer data or the FFT data, is then created at 52 from the analysis and may be stored. This data will become the non-audio data interleaved with the digital audio file at 38. The transmission of the display data will then he transmitted at 40.

Upon reception of the data at 32, the client device will decode the post-processed data at 54 and convert it, if necessary, into data for the appropriate type of display at 56. In a more particular example, the device may send its device identifier that specifically identifies the type of display desired or of which that device is capable, such as a spectrum analyzer display. In this manner, the non-audio data is display data that represents the audio signal in a 'meter' format.

An option that may be available to the user is the ability to 'turn off' the non-audio data. In current implementations, since the digital audio file has been altered, there is no way for the user to avoid receiving the non-audio information. Since the non-audio information resides separately from the digital audio file, if the user decides that the non-audio information is unwanted, the user may be offered the option to not have it transmitted.

Thus, although there has been described to this point a particular embodiment for a method and apparatus to transmit non-audio data interleaved with digital audio data, it is not intended that such specific references be considered as limitations upon the scope of this invention except in-so-far as set forth in the following claims.

What is claimed is:

1. A digital audio device, comprising:

a communications port to communicatively connect the device to a server;

a unique identifier to identify the device when the device is communicatively connected with the server;

a controller to allow transfer of digital audio files from the server, wherein the digital audio files contain interleaved data selected by the server based on the unique identifier; and a decoder to decode the interleaved data.

2. The device of claim 1, wherein the device further comprises a filter to filter the interleaved data.

3. The device of claim 2, wherein the filter is controllable by the user.

4. The device of claim 1, wherein the device comprises one of the group comprised of: personal computer, console digital audio player, and a portable digital audio player.

5. The device of claim 1, wherein interleaved data further comprises one of the group comprised of: a uniform resource locator, graphics, text, and display data.

6. A method of providing information associated with digital audio files, the method comprising:

receiving a file identifier to identify a digital audio file to be downloaded to a client;

receiving a unique identifier associated with the client;

interleaving non-audio information with the digital audio file to create a digital data stream, wherein the non-audio information includes device-specific information selected based on the unique identifier; and transmitting the digital data steam to the client.

7. The method of claim 6, wherein the client is one of the group comprised of: a personal computer, a console digital audio player and a portable digital audio file.

8. The method of claim 6, wherein the method further comprises identifying the non-audio information upon receipt of the file identifier.

9. The method of claim 6, wherein the non-audio information further comprises display data.

10. The method of claim 9, wherein the display data is one of the group comprised of: spectrum analyzer data, VU meter data, and fast Fourier transform data.

11. The method of claim 6, wherein the method further comprises: analyzing the audio data file to create post-processed data; and storing post-processed data as non-audio information to be interleaved with the audio data file.

12. A method of accessing information associated with digital audio files, the method comprising:

transmitting a file identifier to a server to identify a digital audio file to be downloaded;

transmitting a device identifier to the server;

receiving the digital audio file, wherein non-audio information data interleaved with the digital audio file is also received, the non-audio information including device-specific information selected based on the device identifier; and decoding the non-audio information data to provide non-audio information associated with the digital audio file to a user.

13. The method of claim 12, wherein decoding the non-audio information data further comprises extracting display data.

14. The method of claim 13, wherein the display data is one of the group comprised of: spectrum analyzer data, VU meter data and fast Fourier transform data.

15. A digital audio device, comprising:

means for connecting the device to a server;

means for receiving digital audio files from the server, wherein the digital audio files contain interleaved data selected based on an identifier of the device; and means for decoding the interleaved data.

16. The device of claim 15, wherein the means for connecting the device to a server further comprises a communications port.

17. The device of claim 15, wherein the means for transferring digital audio files from the server further comprises a controller.

18. The device of claim 15, wherein the means for decoding the interleaved data further comprises a decoder.

19. The device of claim 15, wherein the device further comprises a means for filtering the interleaved data.

20. An article containing machine-readable code that, when executed, causes a machine to:

transmit a file identifier to a server to identify a digital audio file to be downloaded;

transmit a device identifier to the server;

receive the digital audio file, wherein non-audio information data interleaved with the digital audio file is also received, the non-audio information data including device-specific information selected based on the device identifier; and decode the non-audio information data to provide non-audio information associated with the digital audio file to a user.

21. The article of claim 20, wherein the code that, when executed, causes the machine to decode the non-audio information further comprises code that, when executed, causes the machine to extract display data.

* * * * *